US011198049B2

(12) United States Patent
Huang et al.

(10) Patent No.: US 11,198,049 B2
(45) Date of Patent: Dec. 14, 2021

(54) SWIMMING MACHINE

(71) Applicant: BESTWAY INFLATABLES & MATERIAL CORP., Shanghai (CN)

(72) Inventors: Shuiyong Huang, Shanghai (CN); Wenhua Hu, Shanghai (CN); Qinliang Tan, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 92 days.

(21) Appl. No.: 16/507,869

(22) Filed: Jul. 10, 2019

(65) Prior Publication Data

US 2020/0016471 A1 Jan. 16, 2020

(30) Foreign Application Priority Data

Jul. 10, 2018 (CN) ..... 201821089000.3

(51) Int. Cl.
*A63B 69/12* (2006.01)
*E04H 4/00* (2006.01)
*E04H 4/12* (2006.01)

(52) U.S. Cl.
CPC ..... *A63B 69/125* (2013.01); *E04H 4/0006* (2013.01); *E04H 4/12* (2013.01)

(58) Field of Classification Search
CPC ..... A63B 69/125; A63B 2210/50; A63B 2210/58; E04H 4/0006; E04H 4/12;
(Continued)

(56) References Cited

U.S. PATENT DOCUMENTS 2,272,585 A 2/1942 Rocke
3,534,413 A 10/1970 Plasseraud
(Continued)

FOREIGN PATENT DOCUMENTS

CN 201120112 Y 9/2008
CN 202248991 5/2012
(Continued)

OTHER PUBLICATIONS

Communication pursuant to Article 94(3) EPC (European Office Action) dated Nov. 19, 2020 (Nov. 19, 2020) issued on related European patent application 19185254.0 by the European Patent Office.

(Continued)

*Primary Examiner* — Charles P. Cheyney
(74) *Attorney, Agent, or Firm* — Dickinson Wright PLLC

(57) ABSTRACT

A swimming machine is delineated comprising a water driver for generating a directed flow of water and a housing adapted for receiving the water driver. An adjusting assembly is disposed above the housing and coupled to the housing via an adjustable connector that allows the housing and the adjusting assembly to move relative to each other to set the housing at a desired depth in a pool. A hanging assembly is coupled to the adjusting assembly such that the adjustment assembly can hang on an upper edge of a pool. The swimming machine further includes a supporting assembly independent of the adjusting assembly that is coupled to the housing to move therewith and is disposed below the hanging assembly. The supporting assembly contacts against the inner wall of the pool to support the body.

20 Claims, 19 Drawing Sheets

(58) Field of Classification Search
CPC .... E04H 4/0056; F16M 13/02; F16M 13/022; F16M 11/046
USPC ..... 4/491, 492, 496; 248/214, 640
See application file for complete search history.

(56) References Cited

U.S. PATENT DOCUMENTS

| | | | | | |
|---|---|---|---|---|---|
| 3,674,020 | A | | 7/1972 | Jacuzzi | |
| 3,820,173 | A | | 6/1974 | Weller | |
| 4,001,899 | A | | 1/1977 | Mathis | |
| 4,352,215 | A | | 10/1982 | Laing | |
| 4,375,337 | A | | 3/1983 | Yerger | |
| 4,522,535 | A | | 6/1985 | Bastenhof | |
| 4,561,133 | A | | 12/1985 | Laing | |
| 4,665,572 | A | | 5/1987 | Davidson | |
| 5,044,021 | A | | 9/1991 | Murdock | |
| 5,207,729 | A | | 5/1993 | Hatanaka | |
| 5,222,705 | A | * | 6/1993 | Gibran | F16M 11/04 248/170 |
| 5,298,003 | A | * | 3/1994 | Weihe | A63B 69/125 4/492 |
| 5,597,288 | A | | 1/1997 | Hatanaka | |
| 5,662,557 | A | | 9/1997 | Watterson | |
| 5,662,558 | A | * | 9/1997 | Shannon, III | A63B 69/125 4/488 |
| 6,412,123 | B1 | | 7/2002 | Lau | |
| 6,789,278 | B2 | | 9/2004 | Shea | |
| 7,526,820 | B2 | | 5/2009 | Murdock | |
| 9,979,182 | B2 | | 5/2018 | Lin | |
| 2015/0184411 | A1 | * | 7/2015 | Muller | A61H 33/6005 4/496 |
| 2015/0295397 | A1 | * | 10/2015 | Lin | F16M 11/046 4/491 |
| 2015/0308612 | A1 | * | 10/2015 | Chen | F16M 11/18 248/352 |
| 2019/0360633 | A1 | * | 11/2019 | Schaller | F16M 11/18 |

FOREIGN PATENT DOCUMENTS

| | | |
|---|---|---|
| CN | 205713264 | 11/2016 |
| EP | 1625842 | 2/2006 |
| EP | 3199212 | 8/2017 |
| TW | 266950 | 6/2005 |
| TW | 291828 | 6/2006 |

OTHER PUBLICATIONS

Communication regarding the Extended European Search Report dated Jun. 12, 2019 (Dec. 6, 2019) on related European patent application 19185254.0 issued by the European Patent Office.

* cited by examiner

SWIMMING MACHINE

CROSS-REFERENCE TO RELATED APPLICATION

This U.S. patent application claims priority to and the benefit of Chinese patent application number 201821089000.3, filed Jul. 10, 2018, the entire disclosure of which is incorporated herein by reference.

BACKGROUND OF THE INVENTION

1. Field of the Invention

The present disclosure generally relates to a swimming machine for generating a directed water flow in a swimming pool.

2. Related Art

This section provides background information related to the present disclosure which is not necessarily prior art.

Swimming is a low-impact form of exercise that is popular among a wide range of people. Unfortunately, a limiting factor for people who may be interested in swimming as a form of exercise is that, generally speaking, a pool is needed that is large enough to allow a swimmer to be able swim in one direction long enough to require a substantial physical effort. A swimming pool meeting even minimal requirements will have a length up to several meters, with high cost, and requiring a huge volume of water. Moreover, public swimming pools have a potential risk for safety and health via overcrowding. As such, personal and public swimming pools have significant disadvantages on user experience since they cannot meet the requirement for long distance swimming due to a limited area, an occupied area, high costs, and the like.

In order to address the above issues, swimming machines have been developed that can be mounted in a personal swimming pool and produce a directed water flow with high speed. As such, a swimmer can swim against the directed water flow to achieve a desired amount of physical exertion even in a small pool. One common problem with traditional swimming machines is adapting them to various sized swimming pools. A user needs to adjust the height of the swimming machine and the distance between the wall of the swimming pool and the swimming machine. However, traditional swimming machines include a complicated structure and high cost.

Thus, there is a continuing desire to improve functionality and costs associated with swimming machines that generate a directed water flow.

SUMMARY OF THE INVENTION

This section provides a general summary of the inventive concepts associated with this disclosure and is not intended to be interpreted as a complete and comprehensive listing of all of its aspects, objectives, features, and advantages.

In order to address the above problems existing in the prior art, a swimming machine is provided herein, which has simple structure and low cost.

According to one aspect of the disclosure, the invention provides a swimming machine for generating a directed water flow in a swimming pool. The swimming machine comprises a housing and a water driver at least partially enclosed within the housing. The water driver is adapted for generating the directed water flow. An adjusting assembly is located above and coupled to the housing, wherein the adjusting assembly is adapted to hang on an upper edge of the pool. An adjustable connector is included that couples the adjusting assembly to the housing and that is adjustable to permit moving the housing to any one of a plurality of different depths. A supporting assembly is coupled to and movable with the housing to provide a surface for contacting an inner wall of the pool to support the housing.

According to another aspect of the disclosure, the invention provides a swimming machine for generating a directed water flow in a swimming pool. The swimming machine comprises a housing, a water driver at least partially enclosed within the housing. The water driver is adapted for generating the directed water flow. An adjusting assembly includes a control interface for changing at least one setting of the water driver, wherein the adjusting assembly is located above and coupled to the housing and is adapted to hang on an upper edge of the pool. An adjustable connector is included that couples the adjusting assembly to the housing and is adjustable to permit moving the housing to any one of a plurality of different depths.

BRIEF DESCRIPTION OF THE DRAWINGS

The drawings described herein are for illustrative purposes only of selected embodiments and are not intended to limit the scope of the present disclosure. The inventive concepts associated with the present disclosure will be more readily understood by reference to the following description in combination with the accompanying drawings wherein.

DESCRIPTION OF THE ENABLING EMBODIMENT

The exemplary embodiments of the present disclosure are described below with reference to the drawings for illustration. It should be understood that the description of the exemplary embodiments are merely illustrative of the structure and the principle of the swimming pool, and the present disclosure is not limited to the exemplary embodiments. The drawings and the detailed description should be considered as illustrative of the present disclosure but not limiting the scope of present disclosure.

The terms regarding orientation such as "above", "below", "front", "back" and "side" and the like refer to relative orientation or direction and are used when the swimming machine is in use.

Figure 1:
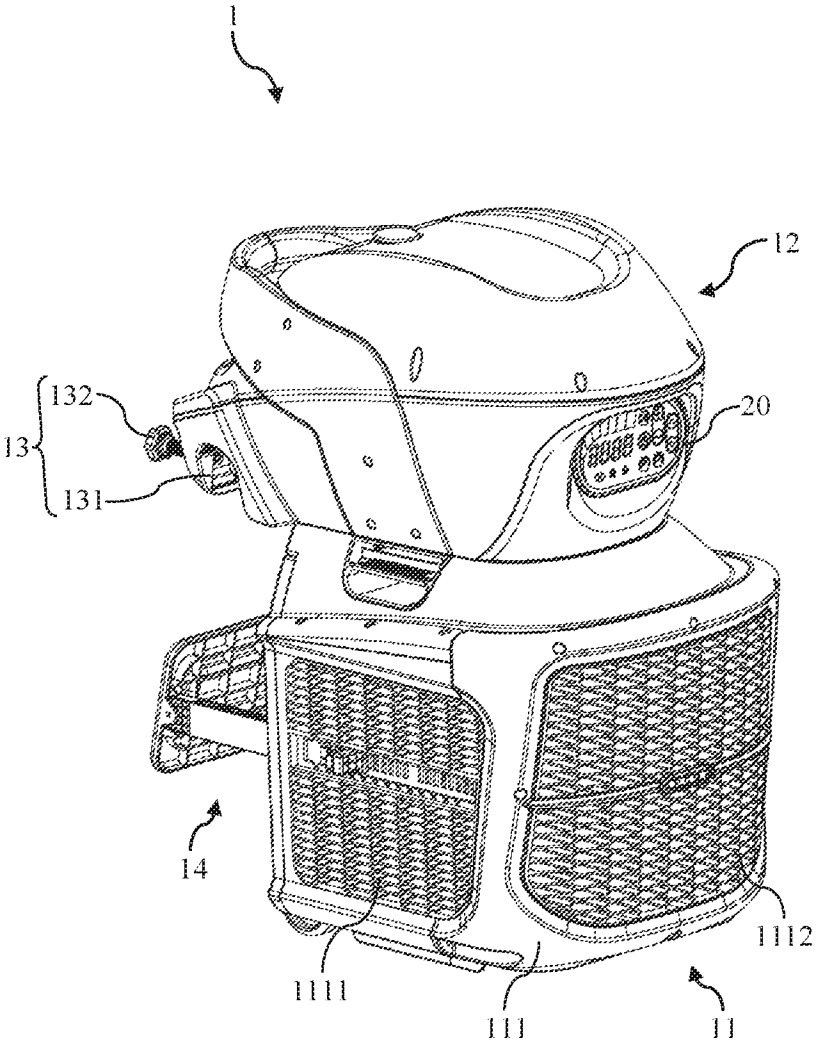
FIG. 1 is a perspective view of a swimming machine according to an exemplary embodiment as described herein.
Figure 4A:
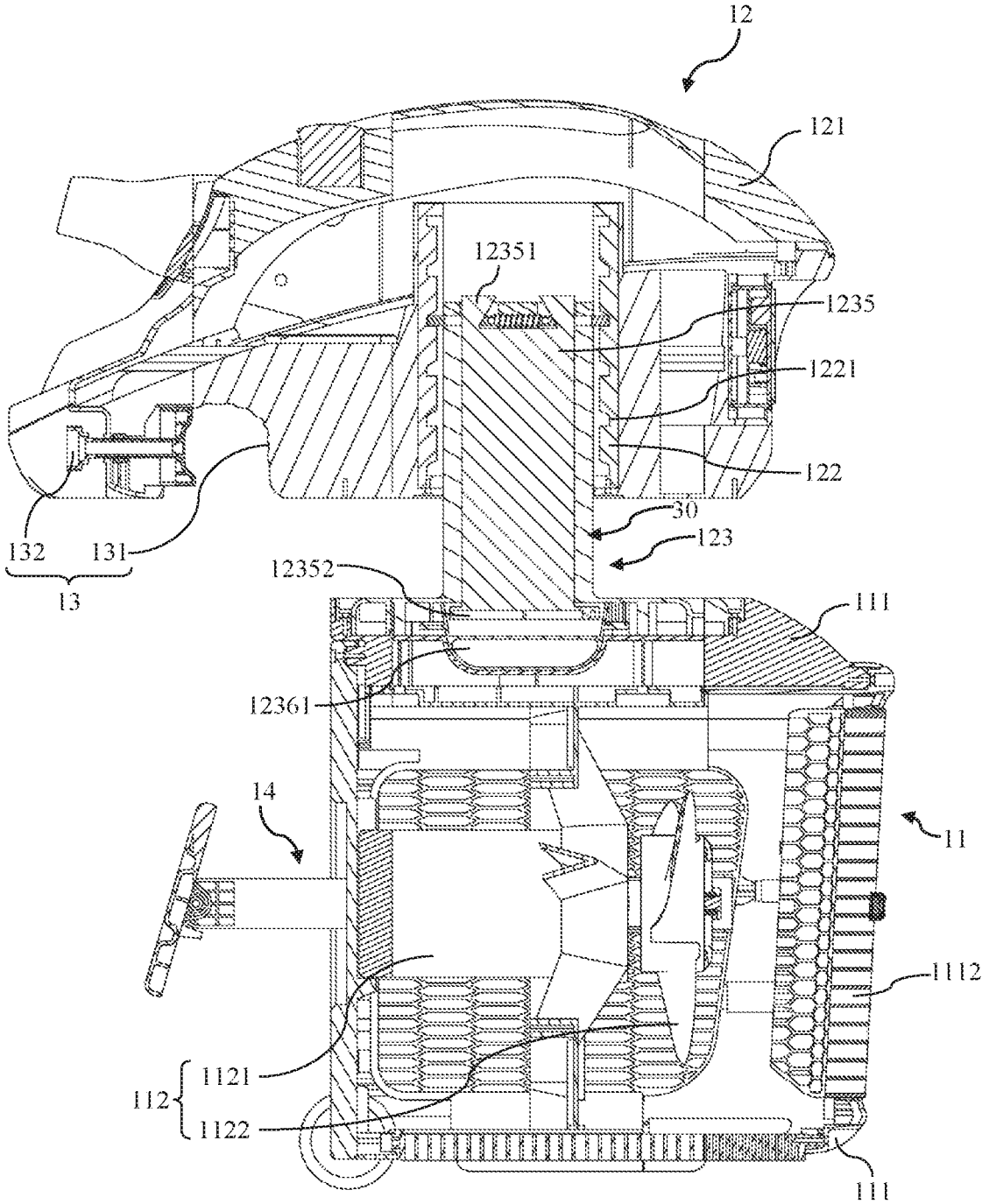
FIG. 4A is a cross-sectional view of the swimming machine as shown in FIG. 1.

As shown in FIG. 1, a swimming machine 1 is provided according to an exemplary embodiment as described herein. The swimming machine 1 comprises a body 11, an adjusting assembly 12, a hanging assembly 13 and a supporting assembly 14. As shown in FIGS. 1 and 4A, the body 11 comprises a water driver 112 and a housing 111 adapted for receiving and at least partially enclosing the water driver 112 and having a fluid inlet 1111 and a fluid outlet 1112. The adjusting assembly 12 is disposed above and coupled to the housing 111. The hanging assembly 13 is coupled to the adjusting assembly 12 and adapted for hanging on an upper edge of the pool. The supporting assembly 14 is independent of the adjusting assembly 12 and coupled to the housing 111, which is disposed below the hanging assembly 13 and abutted against an inner wall of the pool to support the body 11.

In particular, the fluid inlet 1111 is disposed at the side and/or back of the housing 111. The fluid outlet 1112 is disposed at the front of the housing 111. The water driver 112 comprises a motor 1121 and an impeller 1122, as best shown in FIG. 4A. Fluid flows into the housing 111 via the fluid inlet 1111 and is pressurized by the motor 1121 and the impeller 1122 and directed outwardly at a high-speed (directed water flow), which flows out from the fluid outlet 1112.

Figure 2:
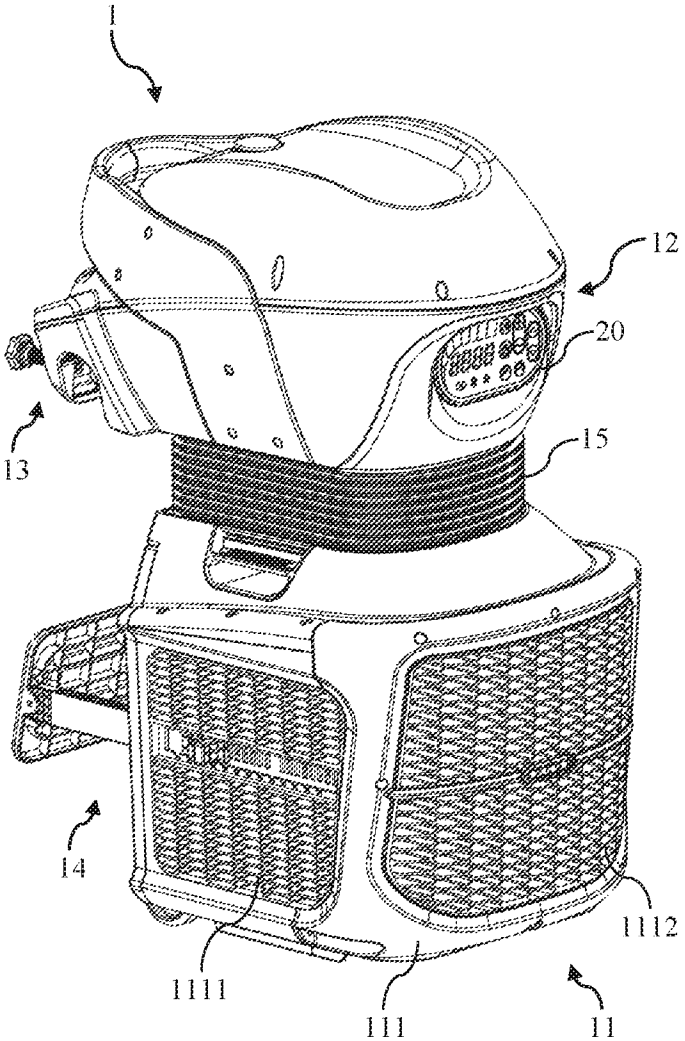
FIG. 2 is a perspective view of the swimming machine according to another exemplary embodiment as described herein.
Figure 3:
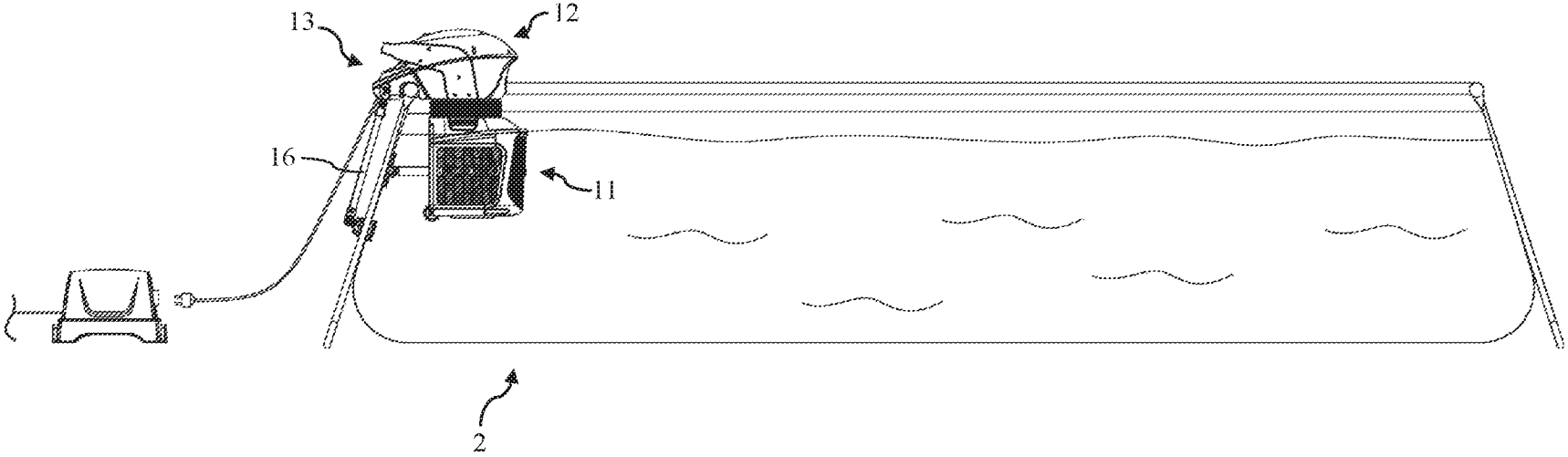
FIG. 3 is an equipment diagram of the swimming machine as shown in FIG. 2 showing attachment to the pool.

As shown in FIG. 2, in another exemplary embodiment described herein, a buffering member 15 is disposed between the body 11 and the adjusting assembly 12 for exhibiting buffering or a dampening effect if and when the body 11 moves relative to the adjusting assembly 12. When the swimming machine 1 is mounted to the pool 2, the hanging assembly 13 is hanged on an upper edge of the pool 2 and further fixed to the outer wall of the pool 2 by a mounting member 16, as shown in FIG. 3. The adjusting assembly 12 includes a control interface 20 (see FIG. 1 and FIG. 2) for changing at least one setting of the water driver 112. The control interface 20 may be attached to the adjustment assembly 12 such that it can stay out of the water while the housing 111 is moved to a preferred depth. The buffering member 15 is shown to at least partially enclose an adjustable connector 30 that connects the adjusting assembly 12 and the housing 111.

In the exemplary embodiment as described herein, the hanging assembly 13 comprises a hanging recess 131 for allowing the upper edge of the pool to fit therein and a fastener 132 passing through the hanging recess 131 to fix the hanging recess 131 and the upper edge of the pool together. The fastener 132 can be a bolt or any other suitable mechanical members.

In this exemplary embodiment, the adjusting assembly 12 comprises an adjusting body 121 and a first connector 122 coupled to the adjusting body 121. The body 11 includes a housing 111 and a second connector 123 coupled to the first connector 122. The first connector 122 and second connector 123 are configured to move relative to one another to adjust the height of the body 11. The first connector 122 and the second connector 123 are part of the adjustable connector 30.

While not limited thereto, the adjusting assembly 12, according to the exemplary embodiments, is shown to be implemented in three different examples. FIGS. 4A to 5B show a first embodiment of the adjusting assembly 12. In particular, the first connector 122 can be detachably coupled to the second connector 123, both of which can be separated from each other when the second connector 123 moves from top to bottom relative to the first connector 122.

Figure 4B:
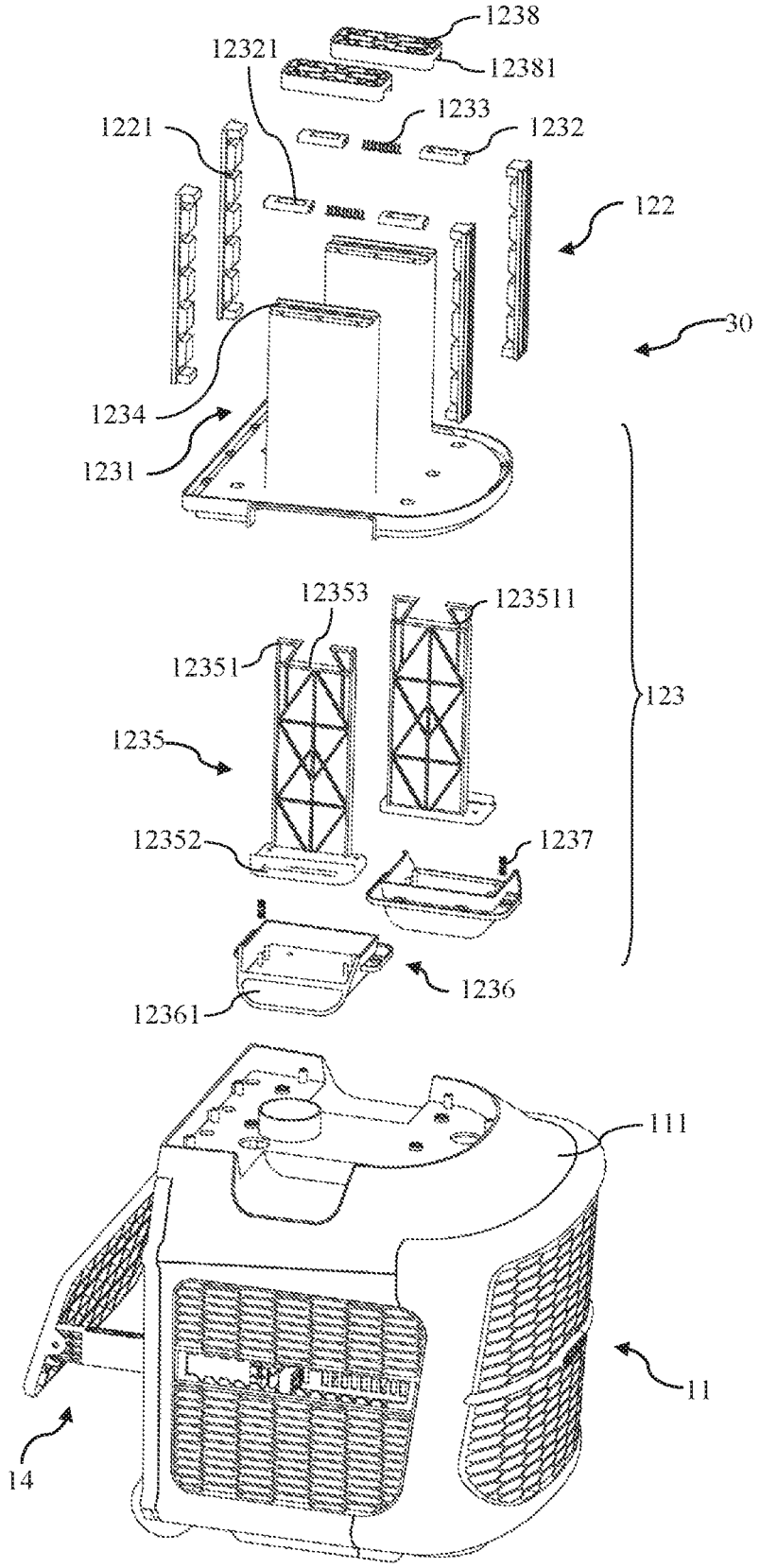
FIG. 4B is a partial exploded view of the swimming machine as shown in FIG. 1.

Still referring to the exemplary adjusting assembly 12 shown in FIGS. 4A and 4B, the first connector 122 is fixedly coupled to the adjusting body 121 and comprises multiple pairs of grooves 1221 arranged from top to bottom. The second connector 123 comprises a supporting part 1231 and paired sliding blocks 1232 disposed on the top of the supporting part 1231, as well as a first spring 1233 disposed between the paired sliding blocks 1232. The paired sliding blocks 1232 are configured to be separated from any one of the multiple pairs of grooves 1221 by compressing the first spring 1233 and to be engaged with any one of the multiple pairs of grooves 1221 by releasing the first spring 1233.

The supporting part 1231 is provided with a guiding part 1234 for the sliding blocks which is located on the top of the supporting part 1231 to allow the paired sliding blocks 1232 to stably slide on the top of the supporting part 1231. The guiding part 1234 for the sliding blocks is configured to receive the paired sliding blocks 1232 and the first spring 1233 and to guide the paired sliding blocks 1232 to press or release the first spring 1233 along the direction of the guiding part 1234 for the sliding blocks. In an alternative embodiment, the guiding part 1234 for the sliding blocks can be disposed below the paired blocks to act as a guideway or channel for the paired sliding blocks 1232.

Figure 5B:
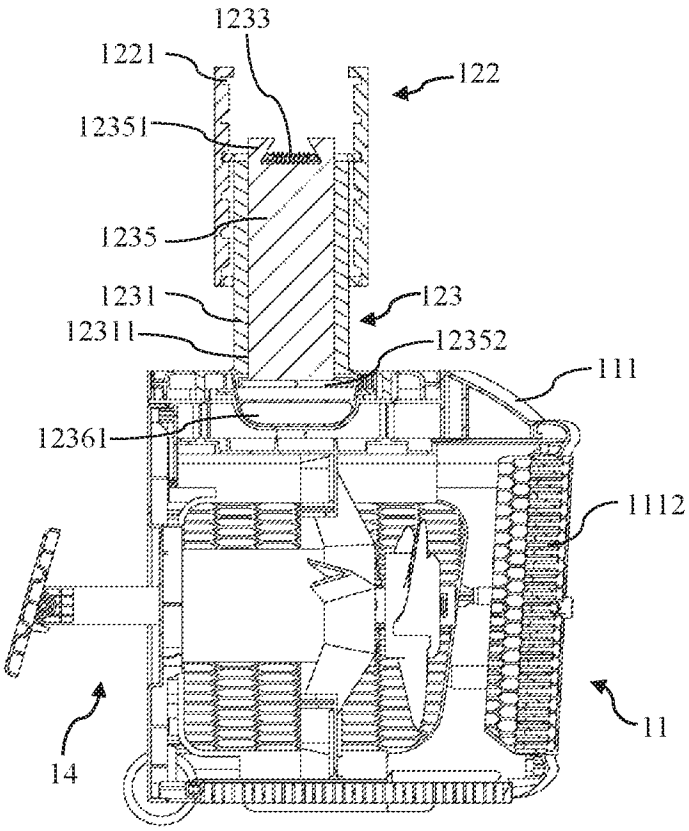
FIG. 5B is a cross-sectional view of the parts of the swimming machine as shown in FIG. 5A.

The second connector 123 further comprises a driving part 1235 for the sliding blocks with protrusions 12351 at both sides of the top thereof and a controlling part 12352 at the bottom thereof. A recess 12353 with a narrow top and a wide bottom is defined between the protrusions 12351 as the protrusions include at least one angled cam surface 123511 (as numbered in FIG. 4B). At least one of the paired sliding blocks 1232 comprises a sliding block hollow part 12321. The supporting part 1231 includes a supporting hollow part 12311 (as shown in FIG. 5B). The driving part 1235 for sliding block is configured to pass through the supporting hollow part 12311 from the bottom of the supporting part 1231 to allow the protrusions 12351 to protrude through the sliding block hollow part 12321. The controlling part 12352 is disposed on the bottom of the supporting part 1231 and is configured to control the protrusions 12351 to drive the paired sliding blocks to press or release the first spring 1233 via upward and/or downward movement of the protrusions 12351 as the angled cam surface 123511 contacts and moves at least one of the paired sliding blocks 1232.

Figure 5A:
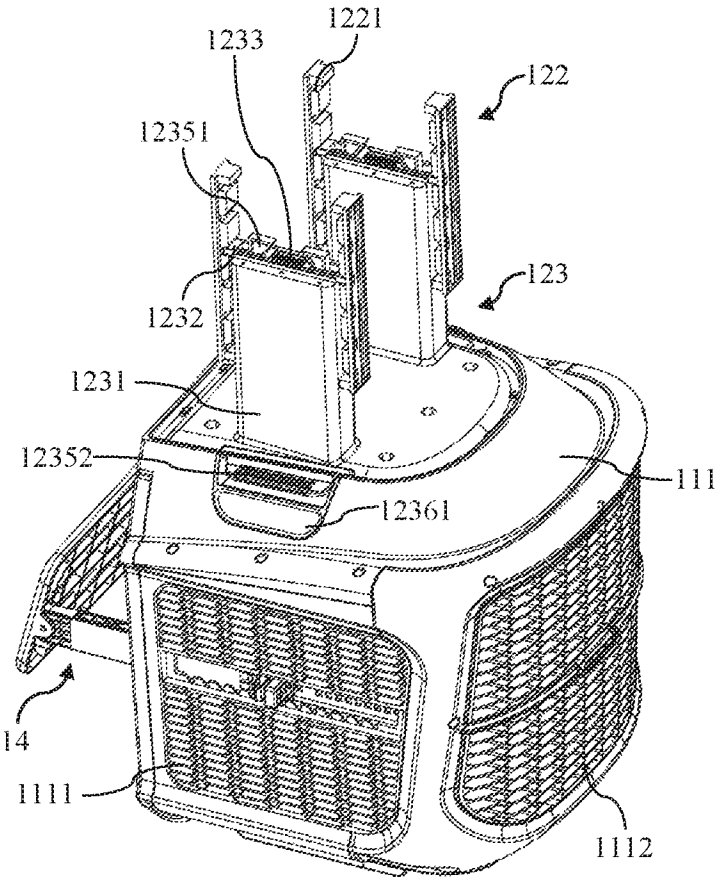
FIG. 5A is a partial perspective view of the swimming machine as shown in FIG. 1, showing a first embodiment of an adjusting assembly and an adjustable connector.

As best shown in FIGS. 4B, 5A, and 5B, the second connector 123 further comprises a holding part 1236 that is disposed between the housing 111 and the controlling part 12352. A second spring 1237 is disposed between the holding part 1236 and the controlling part 12352. The holding part 1236 comprises a holding groove 12361 for fitting a user's hand. When the user holds the holding part 1236 and presses the controlling part 12352 downward, the second spring 1237 is pressed and the protrusions 12351 and angled cam surface 123511 move downward to exert an inclined external force on the paired sliding blocks sideways, so as to drive the paired sliding blocks 1232 towards one another and compress the first spring 1233 until the paired sliding blocks 1232 are separated from any one pair of grooves 1221. Then the body 11 coupled to the second connector 123 can be moved upward and downward as needed. Upon moving the body 11 to a suitable position, the controlling part 12352 is released and recovered to the original location under resilience of the second spring 1237. The paired sliding blocks 1232 are also released by the protrusions 12351 to further release the first spring 1233 to bias and engage with any one of the remaining grooves 1221, thereby fixing the body 11 to a pre-set height or pool depth. In this example, the protrusions 12351 have a cross-section of a right-angled trapezoid. In an alternative example, the protrusions 12351 can be in any other suitable shape, as long as the recess defined by the protrusions 12351 is in a shape with a narrow top and a wide bottom or vice versa. In the present embodiment, the controlling part 12352 is a plate with anti-slipping strips on the surface thereof. In an alternative example, the controlling part 12352 can be in any other suitable shape without anti-slipping strips on the surface thereof. It should also be appreciated that in alternative embodiments, the holding part may be omitted.

Still referring to FIGS. 4B, 5A, and 5B, the second connector 123 may further comprise an external cover 1238 for fixing on a top of the supporting part 1231 and receiving the protrusions 12351, the paired sliding blocks 1232, the guiding part 1234 for sliding block and the first spring 1233. The external cover 1238 comprises a cover groove 12381 for allowing the paired sliding blocks 1232 to pass therealong.

Figure 6B:
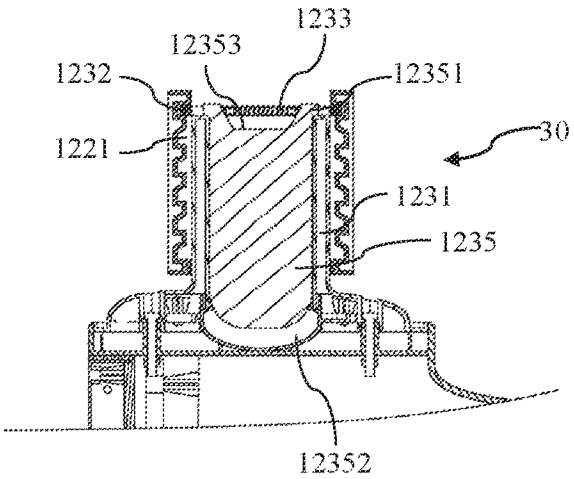
FIG. 6B is a cross-sectional view of the swimming machine as shown in FIG. 6A, showing engagement of a first connector and a second connector of the adjustable connector.
Figure 6A:
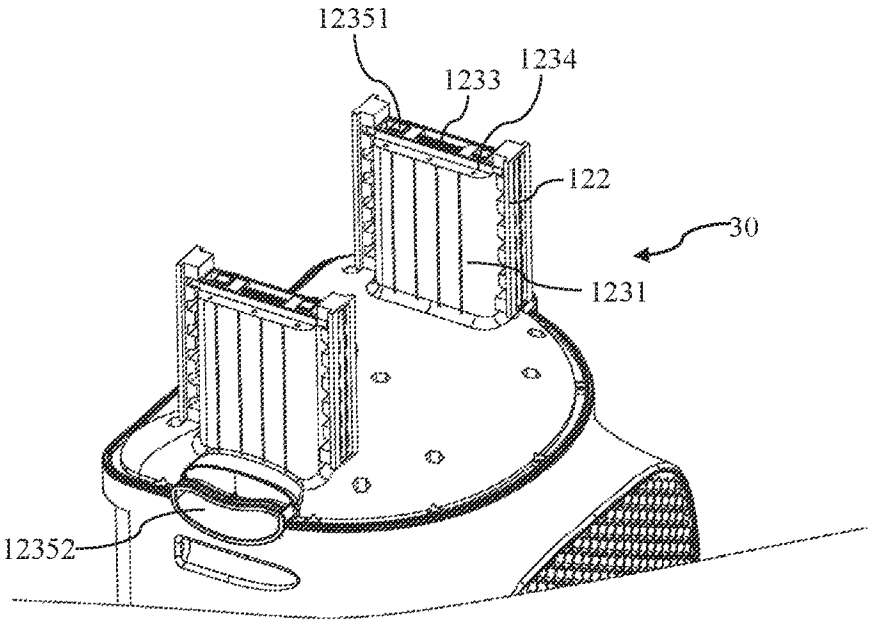
FIG. 6A is a partial perspective view of the swimming machine according to an exemplary embodiment as described herein, showing a second embodiment of the adjusting assembly.
Figure 6D:
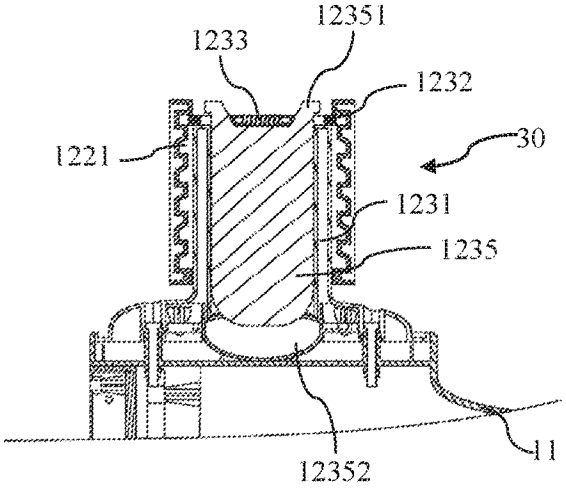
FIG. 6D is a cross-sectional view of the swimming machine as shown in FIG. 6A, showing separation of the first connector from the second connector.
Figure 6C:
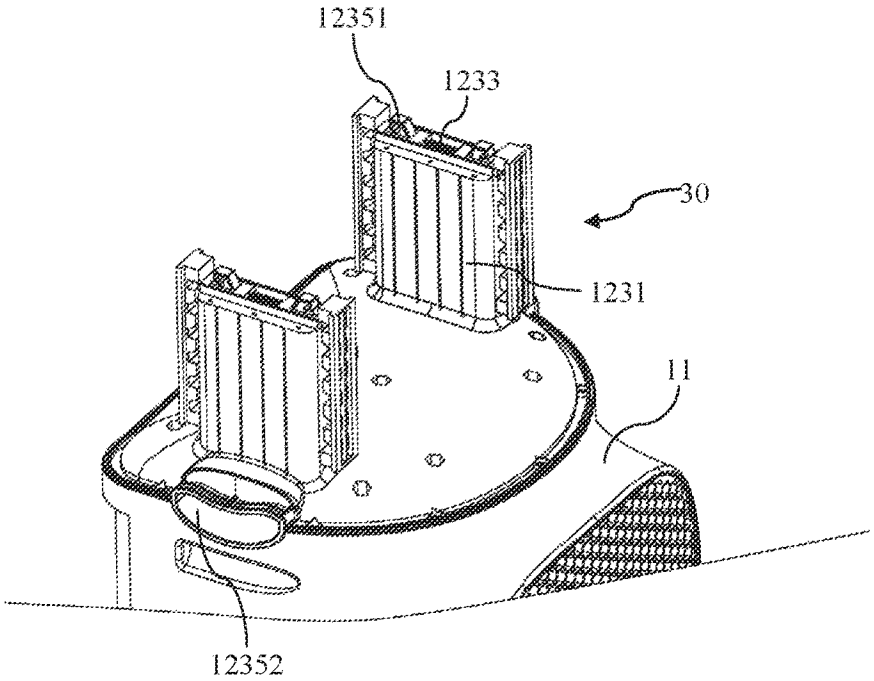
FIG. 6C is a partial perspective view of the swimming machine as shown in FIG. 6A, showing separation of the first connector from the second connector.
Figure 7:
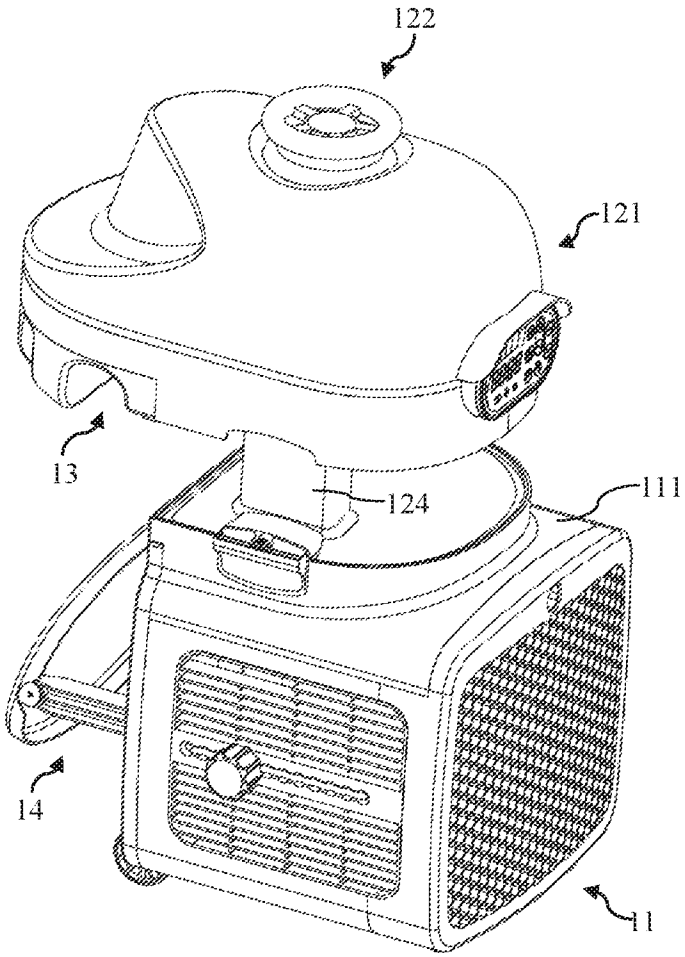
FIG. 7 is a perspective view of the swimming machine according to an exemplary embodiment as described herein, showing a third embodiment of the adjusting assembly.

FIGS. 6A through 6D show a second embodiment for the adjusting assembly 12. The adjusting assembly 12 of this embodiment is different from the one of the first embodiment in that a modified recess 12353 includes a wide top and a narrow bottom that can be defined between protrusions 12351. Similarly to the previous embodiment, the controlling part 12352 is configured to move upward by controlling the protrusions 12351 to drive the paired sliding blocks 1232 to press or release the first spring 1233. Other members may be the same as those of the first embodiment. In this case, the holding part and the second spring may be omitted. The controlling part 12352 has a hollow part for ease of operation by a user. FIGS. 6A and 6B show engagement of the paired sliding blocks with any pair of grooves 1221. FIGS. 6C and 6D show separation of the paired sliding blocks from any pair of grooves 1221. When the controlling part 12352 drives the driving part for sliding block to move upward, the protrusions 12351 move upward to drive the paired sliding blocks 1232 to press the first spring 1233 until the paired sliding blocks 1232 are separated from any pair of grooves 1221. As shown in FIGS. 6C and 6D, the body 11 coupled to the second connector 123 moves upward or downward as needed upon release of the sliding blocks 1232. Upon moving the body 11 to the suitable position, the controlling part 12352 is released to the original location under gravity or a spring. The paired sliding blocks 1232 are released by the protrusions 12351 to further release the first spring 1233 and engage with any one of the pair of grooves 1221, thereby fixing the body 11 to a pre-set height or pool depth. In this exemplary embodiment, the protrusions 12351 have a cross-section of a right-angled trapezoid. In alternative embodiments, the protrusions 12351 can be in any other suitable shape as long as the protrusions 12351 define the recess with a wide top and a narrow bottom or vice versa.

In an alternative embodiment, no controlling part is needed. More specifically, separation or engagement of the paired sliding blocks 1232 from/with any pair of grooves 1221 can be achieved by arranging the driving part 1235 for the sliding blocks, which can move upward and downward, arranging the protrusions 12351 on the top of the driving part 1235 for sliding blocks and arranging the spring on the bottom of the driving part for the sliding blocks. In this configuration, the user can manually and directly drive the protrusions to move upward (e.g., the protrusions define a recess with a wide top and a narrow bottom, and the spring is tensioned) or move downward (e.g., the protrusions define a recess with a narrow top and a wide bottom and the spring is compacted) to drive the paired sliding blocks to press the first spring along the direction of the guiding part for the sliding blocks, which in turn results in separation of the paired sliding blocks from any of the pair of the grooves. The body 11 coupled to the second connector 123 moves upward and downward, as needed. Upon moving the body 11 to a suitable location, the protrusions 12351 are released and return to the original location under resilience of the spring. At the same time, the paired sliding blocks 1232 are released by the protrusions 12351, which are engaged with any pair of remaining grooves to fix the body 11 to a pre-set height or pool depth. It should be appreciated that in other alternative embodiments, separation or engagement of the paired sliding blocks from/with any pair of grooves can be achieved by other arrangements without departing from the scope of the subject disclosure.

FIGS. 7 through 9B show a third embodiment of the adjusting assembly 12. The adjusting assembly 12 of this embodiment is different from those of the above examples in that the first connector 122 is configured to drive the second connector 123 to move upward or downward by rotation. More particularly, the adjusting body 121 has a perforated body opening 1211, through which the bottom of the first connector 122 passes through to be in threaded connection with the second connector 123. The top of the first connector 122 is fixed to the body opening 1211. The first connector 122 is configured to rotate around an axis of the body opening 1211 with respect to the adjusting body 121 to drive the second connector 123 to move upward or downward based on the direction of rotation.

A radial protrusion 1222 is disposed on the top of the first connector 122, which can be fixed to the body opening 1211. The radial protrusion 1222 has a diameter greater than that of the body opening 1211 to prevent the first connector 122 from moving downward during rotation. The adjusting body 121 comprises a first fixing member 1212 that is configured to rotatably fix the radial protrusion 1222 to the body opening 1211 and to prevent the first connector 122 from moving upward. In this example, the body opening has a stepped shape. In an alternative embodiment, the body opening can be in any other suitable shape and the first connector and/or the adjusting body can be rotated relative to the second connector to drive the second connector to move upward or downward by any other suitable arrangements.

Figure 8A:
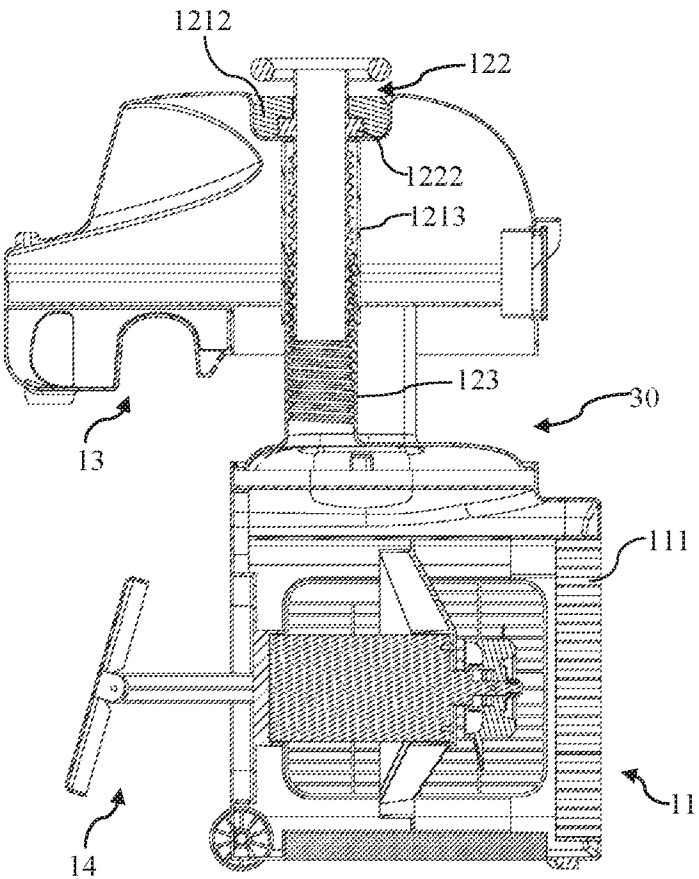
FIG. 8A is a cross-sectional view of the swimming machine as shown in FIG. 7.
Figure 8B:
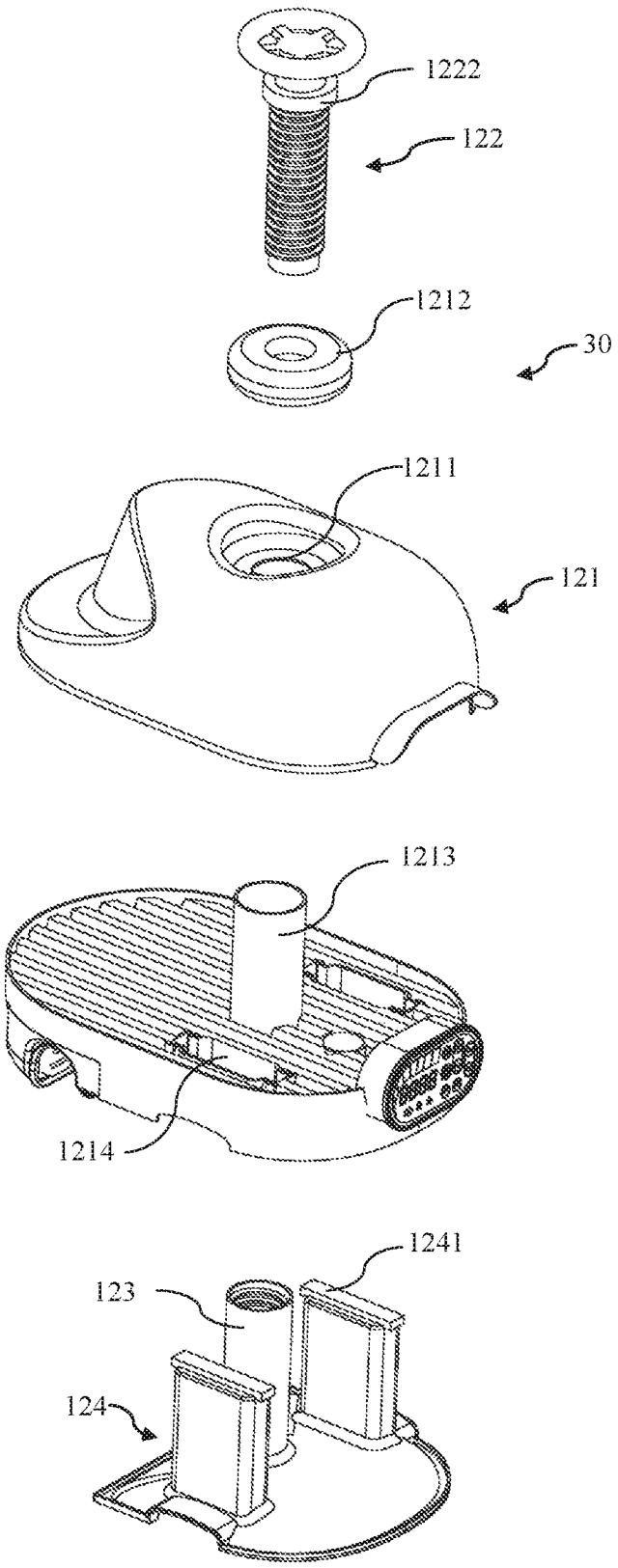
FIG. 8B is an exploded view of the swimming machine as shown in FIG. 7.

As shown in FIGS. 8A and 8B, the adjusting body 121 further comprises a connector guiding part 1213 to allow the second connector 123 to stably move upward or downward relative to the first connector 122. The connector guiding part 1213 passes through the body opening 1211, through which the bottom of the first connector 122 passes to insert into the connector guiding part 1213. The top of the second connector 123 is configured to insert into the connector guiding part 1213 to be in threaded connection with the first connector 122. In an alternative embodiment, the second connector can be coupled to the first connector by any other suitable mechanical connection, as long as the second connector can move upward or downward relative to the first connector.

Figure 9B:
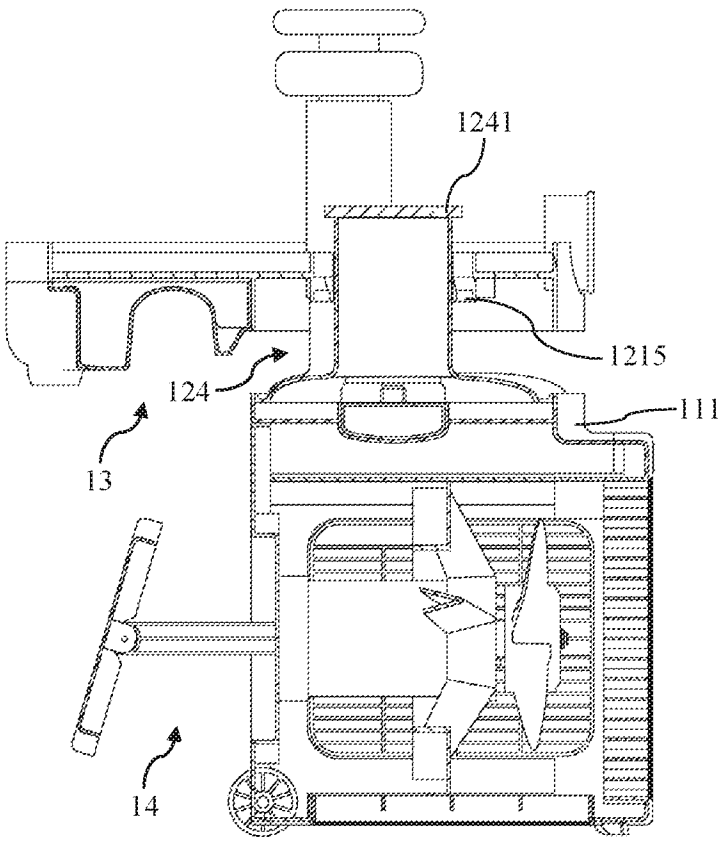
FIG. 9B is a partial cross-sectional view of the swimming machine as shown in FIG. 9A, showing the limiting member, the limiting protrusion, and a limiting protrusion engaging part.
Figure 9A:
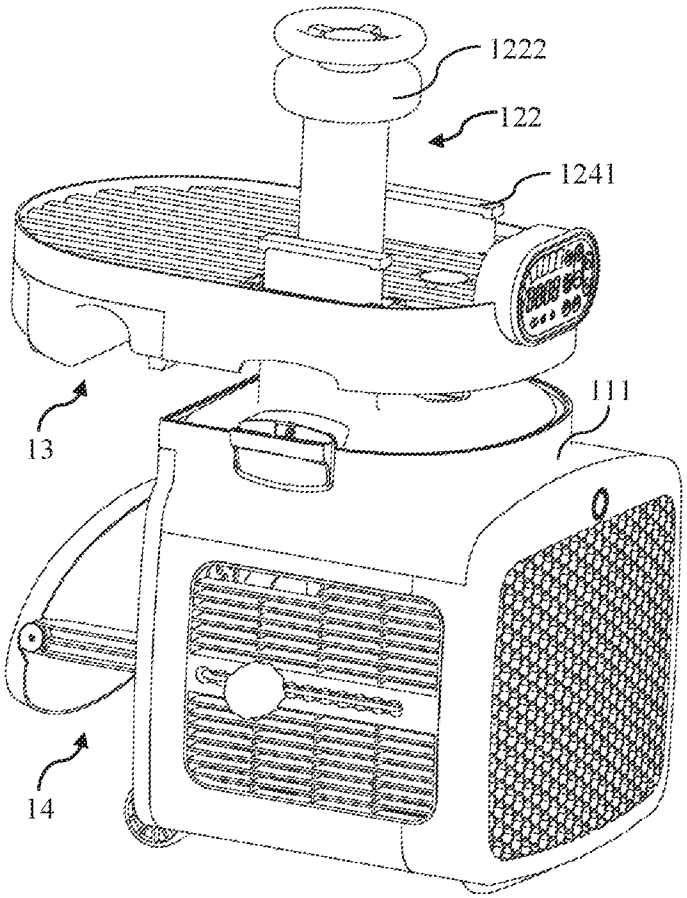
FIG. 9A is a partial perspective view of the swimming machine as shown in FIG. 7, showing a limiting member and a limiting protrusion.

As shown in FIGS. 9A and 9B, the adjusting assembly 12 further comprises a limiting member 124 to limit the distance for downward movement of the second connector 123 relative to the first connector 122 and prevent detachment during lowering. The limiting member 124 is coupled to the second connector 123, with a limiting protrusion 1241 on the top thereof. The adjusting body 121 further comprises a receiving part 1214 comprising an engaging part 1215 for limiting protrusion and allowing the limiting member 124 to insert therein and move upward and downward. The engaging part 1215 for the limiting protrusion is configured to engage with the limiting protrusion 1241 once the limiting member 124 has been lowered to a predetermined height, so as to prevent the limiting member 124 from becoming detached.

Figure 10:
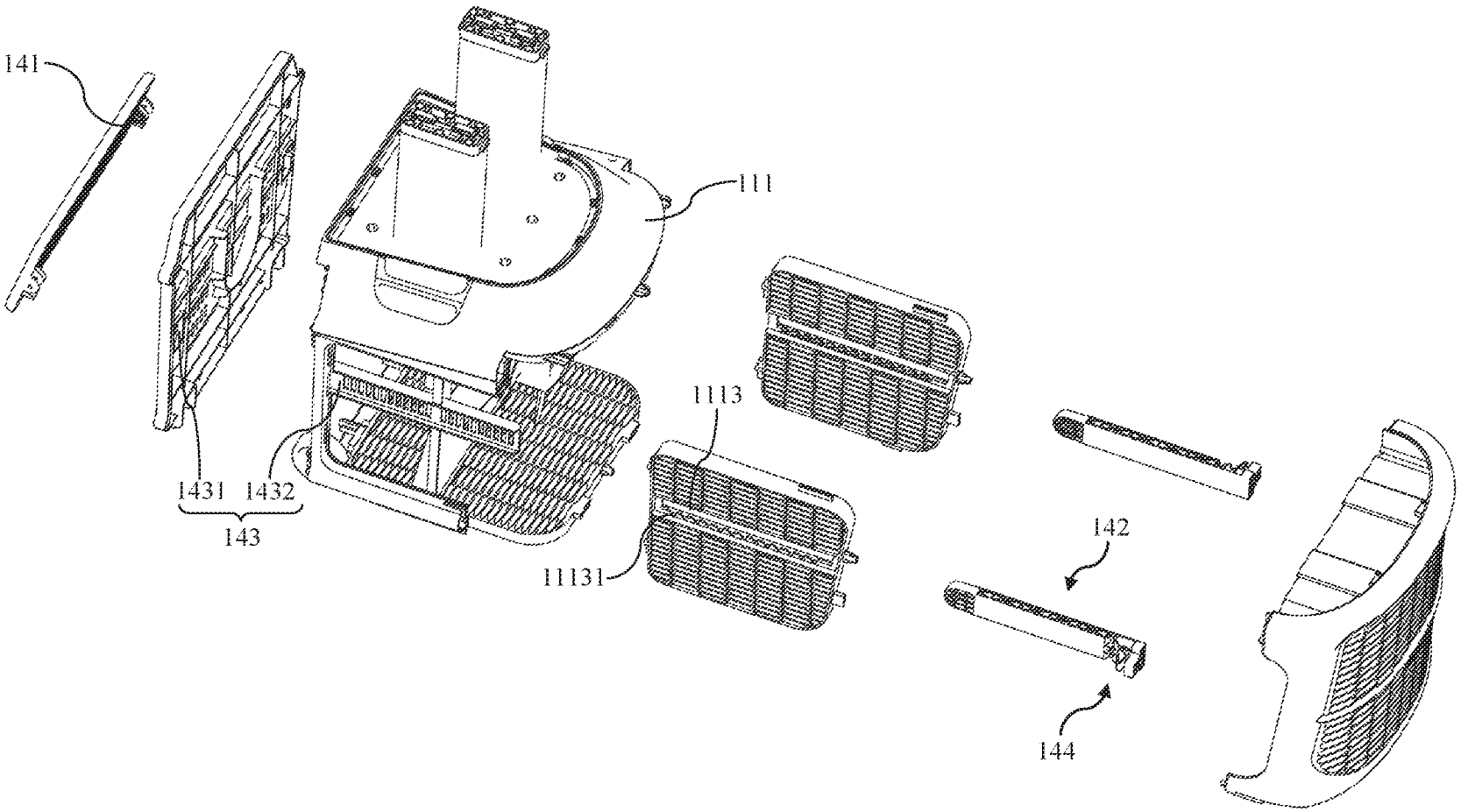
FIG. 10 is a partial exploded view of the swimming machine as shown in FIG. 1, showing a first embodiment of a supporting assembly.

As shown in FIG. 10, the supporting assembly 14 comprises a supporting member 141 and a sliding member 142 coupled to the supporting member 141 at the back thereof. The housing 111 has guiding parts 143 for sliding member at the back and side thereof. The front of the sliding member 142 moves forward and backward along the guiding part 143 for the sliding member. The supporting assembly 14 further comprises a second fixing member 144 (or slide fixing member) configured to fix the sliding member 142 to a pre-set (i.e., predetermined) location, on which the supporting member 141 is in contact against the inner wall of the pool. The further the sliding member 142 is extended, the greater the downward angle of directed water flow.

The supporting assembly 14 will be described below in detail according to three non-limiting exemplary embodiments. In the first and second embodiments of the supporting assembly 14, the second fixing member 144 is disposed at the front of the sliding member 142. A side opening 1113 is disposed at the side of the housing 111, which is arranged parallel to the guiding part 143 for sliding member. The second fixing member 144 is configured to fix the sliding member 142 to a pre-set location through the side opening 1113.

Figure 13:
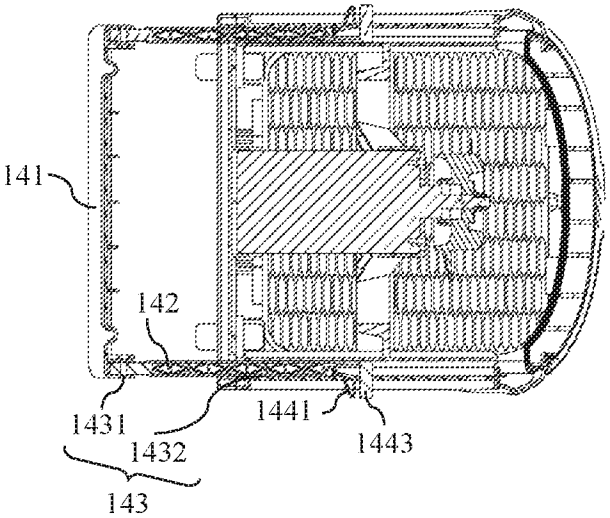
FIG. 13 is a cross-sectional view of the swimming machine as shown in FIG. 12A.
Figure 12A:
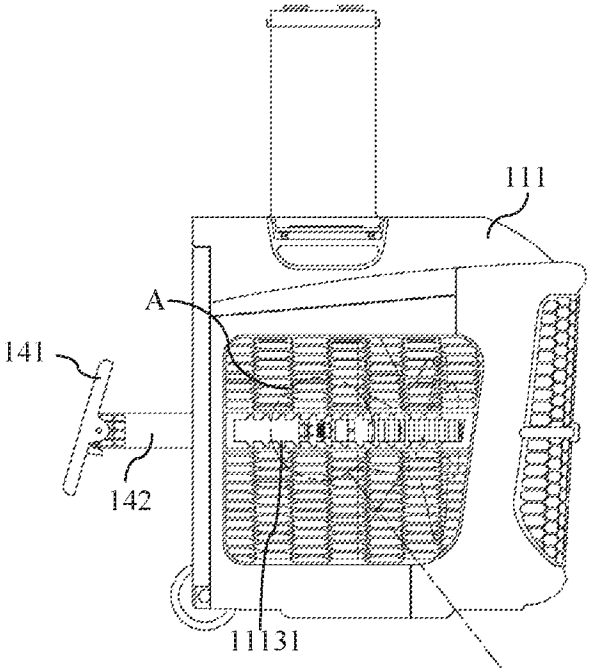
FIG. 12A is the front view of the parts of the swimming machine as shown in FIG. 10.
Figure 12B:
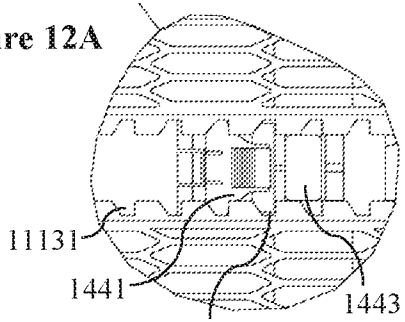
FIG. 12B is an enlarged view of area "A" from FIG. 12A.
Figure 14:
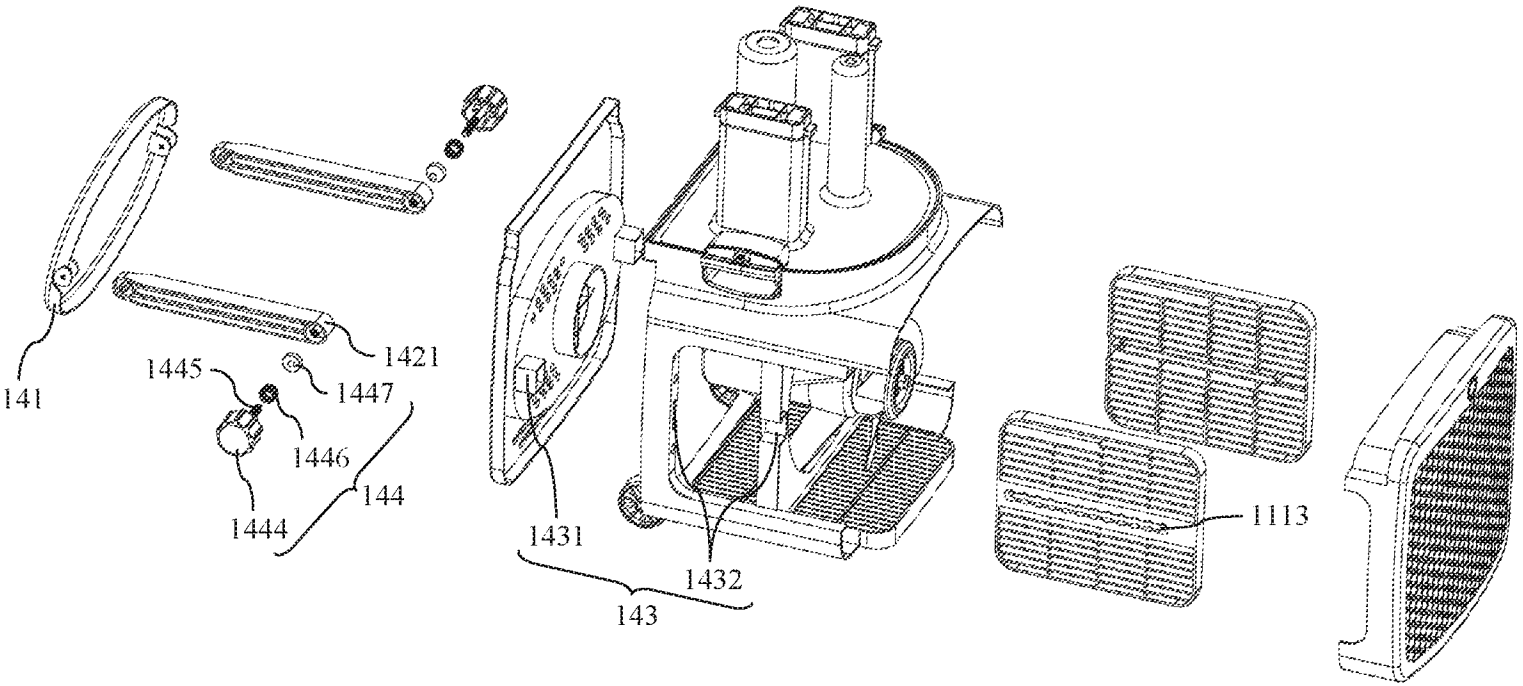
FIG. 14 is a partial exploded view of the swimming machine as shown in FIG. 7, showing a second embodiment of the supporting assembly.

FIGS. 10 to 13 show the first embodiment for the support assembly 14. As shown, the second fixing member 144 comprises an elastic stopping part 1442 and a pressing part 1441 disposed above the elastic stopping part 1442. Pressing the pressing part 1441 causes corresponding deformation and compression of the elastic stopping part 1442. The pressing part 1441 is configured to protrude from the side opening 1113 (as shown in FIG. 13) and slide with the sliding member 142 to be accessible to a user. The side opening 1113 has a stopping engaging part 11131 for engaging with the elastic stopping part 1442 to stop sliding of the sliding member 142. The elastic stopping part 1442 is also configured to separate from the stopping engaging part 11131 under pressure by the pressing part 1441 to allow the sliding member 142 to slide forwards and backwards. As shown in FIG. 10, the stopping engaging part 11131 is a groove disposed on the bottom of the side opening 1113. In an alternative example, the stopping engaging part 11131 can be a groove on the top of the side opening 1113, or can be multiple grooves on the top and bottom of the side opening 1113. The guiding part 143 for sliding member comprises a guiding opening 1431 at the back of the housing 111 and a side guiding part 1432 corresponsive to the guiding opening 1431, which continuously extends from the back to the front of the side of the housing 111. In an alternative embodiment, the side guiding part can be discontinuous, as long as it is corresponds to the guiding opening and is adapted for guiding the sliding member to move forward and backward.

Figure 11C:
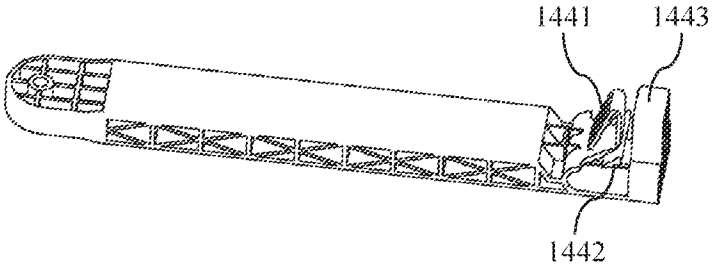
FIG. 11C is a perspective view of the sliding member and the second fixing member of the supporting assembly as shown in FIG. 10.
Figure 11A:
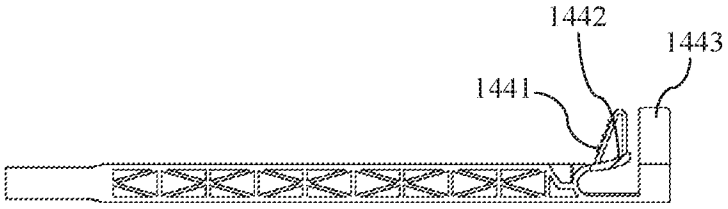
FIG. 11A is a cross-sectional view of a sliding member and a second fixing member of the supporting assembly as shown in FIG. 10.
Figure 11B:
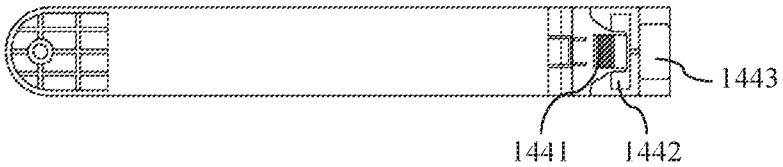
FIG. 11B is a top view of the sliding member and the second fixing member of the supporting assembly as shown in FIG. 10.

The second fixing member 144 further comprises a pressing supporting part 1443 configured to protrude from the side opening 1113 (as shown in FIG. 13) and slide with the sliding member 142, which is disposed at the front of the pressing part 1441. As such, the pressing part 1441 is supported by the pressing supporting part 143 when the pressing part 1441 presses the elastic stopping part 1442. The pressing supporting part 1443 is shaped to be easy to grasp by a user in order to operate the pressing part 1441. As shown in FIGS. 10 and 11B, the pressing supporting part 1443 is illustrated with a narrow external portion and wide internal portion that allows the internal side to be located within the housing 111 and protected from environmental harms. The external side 14431 protrudes from the side opening 1113. In this example, as shown in FIGS. 11A through 11C, the pressing supporting part 1443 has an external side and an internal side having a rectangle shape. In an alternative example, the pressing supporting part can be in any other suitable shape. In an alternative embodiment, the internal side of the pressing supporting part can have the same width as that of the external side. In another alternative example, no pressing supporting part is included.

FIGS. 14 through 16B illustrate a second embodiment for the supporting assembly 14. The difference between the supporting assembly 14 in this example and the one in the first embodiment will be described below. Referring initially to FIGS. 14 through 16A, the recess which acts as the stopping engaging part within the side opening 1113 is omitted. The side guiding part 1432 of the guiding part 143 for the sliding member can be discontinuous or continuous. The second fixing member 144 is shown with a modified configuration different than the previous embodiment. In this embodiment, the second fixing member 144 comprises a rotation part 1444, a rotation rod 1445 protruding from the rotation part 1444, a rotation limiting part 1447, and a third spring 1446 sleeved on the rotation rod 1445 and being disposed between the rotation part 1444 and the rotation limiting part 1447. The sliding member 142 has an engaging part 1421 (or rotation engaging part 1421) for the rotation rod at the front thereof. When the rotation part 1444 is rotated to the rotation limiting part 1447 and snapped into the side opening 1113, the rotation rod 1445 is engaged with the engaging part 1421 for the rotation rod in order to prevent further sliding of the sliding member 142. In this example, the rotation limiting part 1447 may exhibit deformation and can be snapped into side opening 1113 by producing deformation, as shown in FIG. 16A.

Figure 16A:
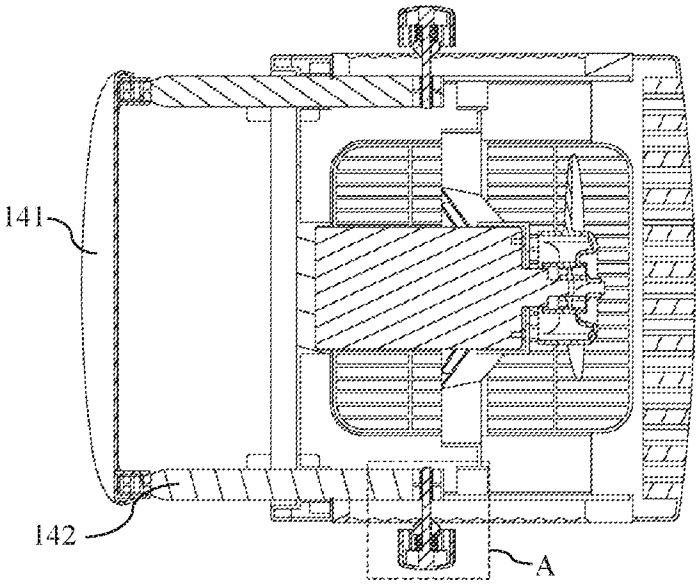
FIG. 16A is a cross-sectional view of the swimming machine as shown in FIG. 14.
Figure 15:
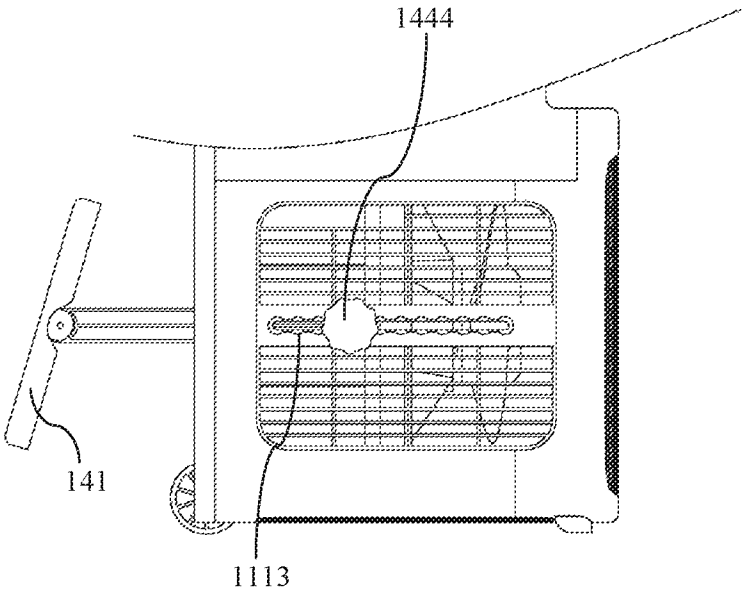
FIG. 15 is a partial front view of the swimming machine as shown in FIG. 14.
Figure 16B:
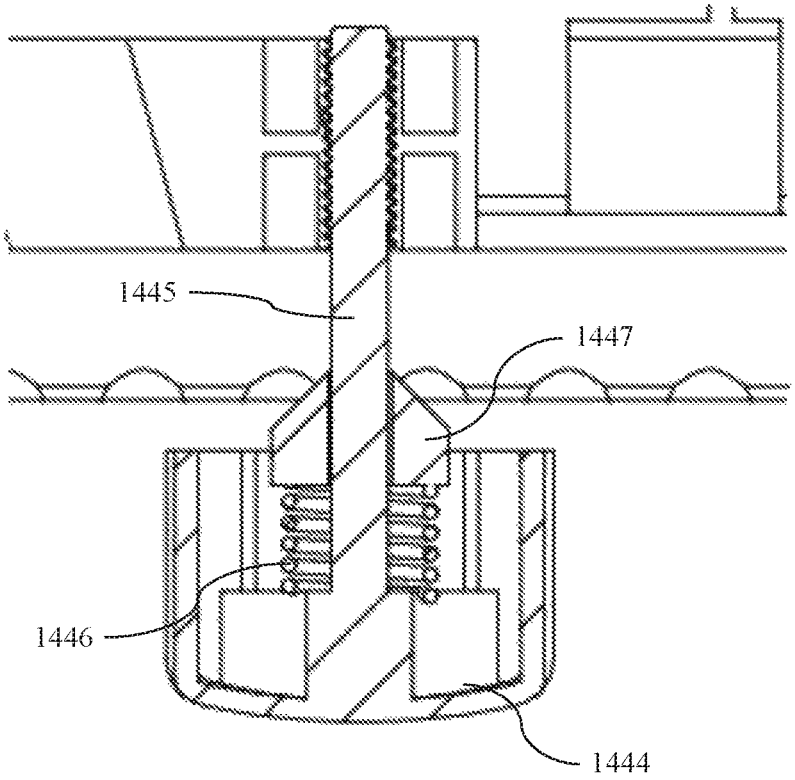
FIG. 16B is an enlarged view of area "A" from FIG. 16A.

As shown in FIGS. 16A and 16B, external threads are disposed on the outer surface of the rotation rod 1445 and the engaging part 1421 for the rotation rod includes an opening at the front of the sliding member 142, which is correspondingly threaded to receive the rotation rod 1445. In particular, internal threads are disposed on the inner surface of the engaging part 1421 for the rotation rod, which are corresponding to the external threads of the rotation rod 1445. When the sliding member 142 slides to a pre-set position, the rotation part 1444 can be rotated to the rotation limiting part 1447 to exhibit deformation so as to be snapped into the side opening 1113. Meanwhile, the external threads of the rotation rod 1445 can match with the internal threads of the engaging part 1421 for the rotation rod, thereby stopping sliding of the sliding member 142 and allowing the supporting member 141 to contact against the inner wall of the pool such that the directed water flow is at a desired angle. In order to adjust the position of the supporting member 141, the rotation part 1444 is rotated to the rotation limiting part 1447 to detach from the side opening 1113 such that the external threads of the rotation rod 1445 are separated from the internal threads of the engaging part 1421 for the rotation rod. As such, the sliding member 142 drives the supporting member 141 to move forward or backward to other positions along the guiding part 143 for the sliding member. In an alternative embodiments, the rotation rod can be detachably coupled to the engaging part 1421 for the rotation rod by other mechanical connection means.

Figure 17A:
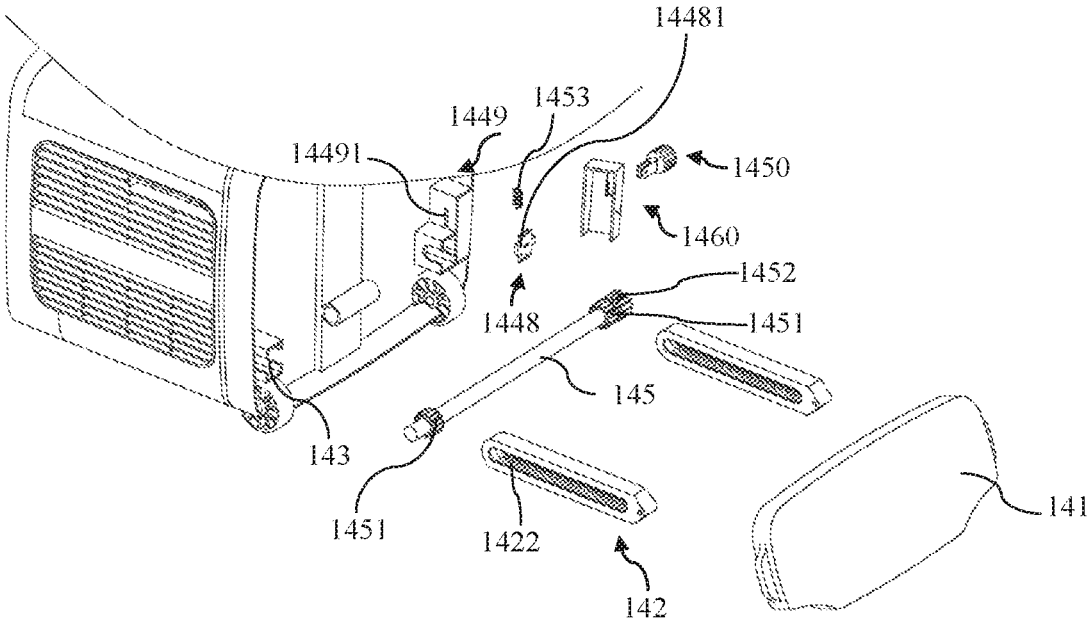
FIG. 17A is a partial exploded view of the swimming machine according to an exemplary embodiment as described herein, showing a third embodiment of the supporting assembly.
Figure 17B:
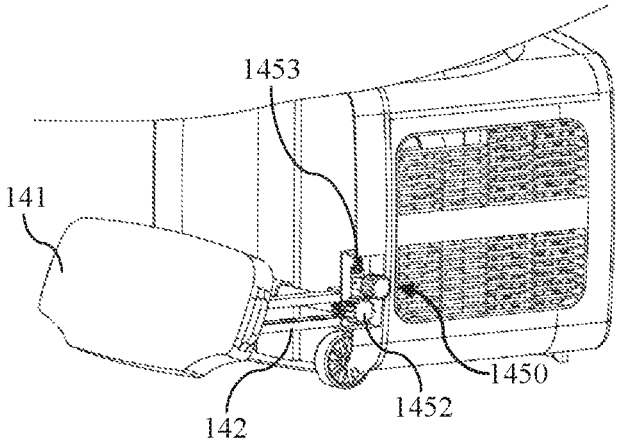
FIG. 17B is a partial perspective view of the swimming machine as shown in FIG. 17A.

FIGS. 17A through 19D show a third embodiment for supporting assembly 14. In addition to details about the third embodiment, differences between the third embodiment and other examples will be described. Referring initially to FIGS. 17A and 17B, the supporting assembly 14 further comprises a supporting rod 145 mounted at the back of the housing 111 and having a first ratchet 1451 and a second ratchet 1452 which are adjacent to each other. The second ratchet 1452 is disposed outside of the first ratchet 1451. The sliding member 142 in this embodiment is modified from the one in the first embodiment in that the sliding member 142 has a hollow part with a third ratchet 1422 disposed therein, adapted for engaging with the first ratchet 1451, wherein the second ratchet 1452 is disposed outside of the hollow part. The first ratchet 1451 and third ratchet 1422 are shown as a rack-and-pinion type connection.

When the sliding member 142 moves forward or backward along the guiding part 143 for sliding member, the third ratchet 1422 of the sliding member 142 is engaged with the first ratchet 1451 to drive rotation of the first ratchet 1451 and to indirectly drive rotation of the second ratchet 1452 that is spaced from the third ratchet 1422. In the present embodiment, there are two first ratchets and two third ratchets (two mating pairs) and one second ratchets. In alternative embodiments, the number of the first, second and third ratchets can vary based on weight and other limitations.

The second fixing member 144 in this example is different from the one in the first embodiment. The second fixing member 144 in this example comprises a location part 1448 adapted for engaging with the second ratchet 1452 (teeth of the ratchet) to stop sliding of the sliding member 142. A location supporting part 1449 is mounted at the back of the housing 111 to support the location part 1448. In particular, the location part 1448 has a first horizontal protrusion 14481. The location supporting part 1449 has a first supporting opening 14491 for allowing the first horizontal protrusion 14481 to insert therein and support the first horizontal protrusion 14481 (as shown in FIGS. 17A and 19A through 19D).

Figure 18:
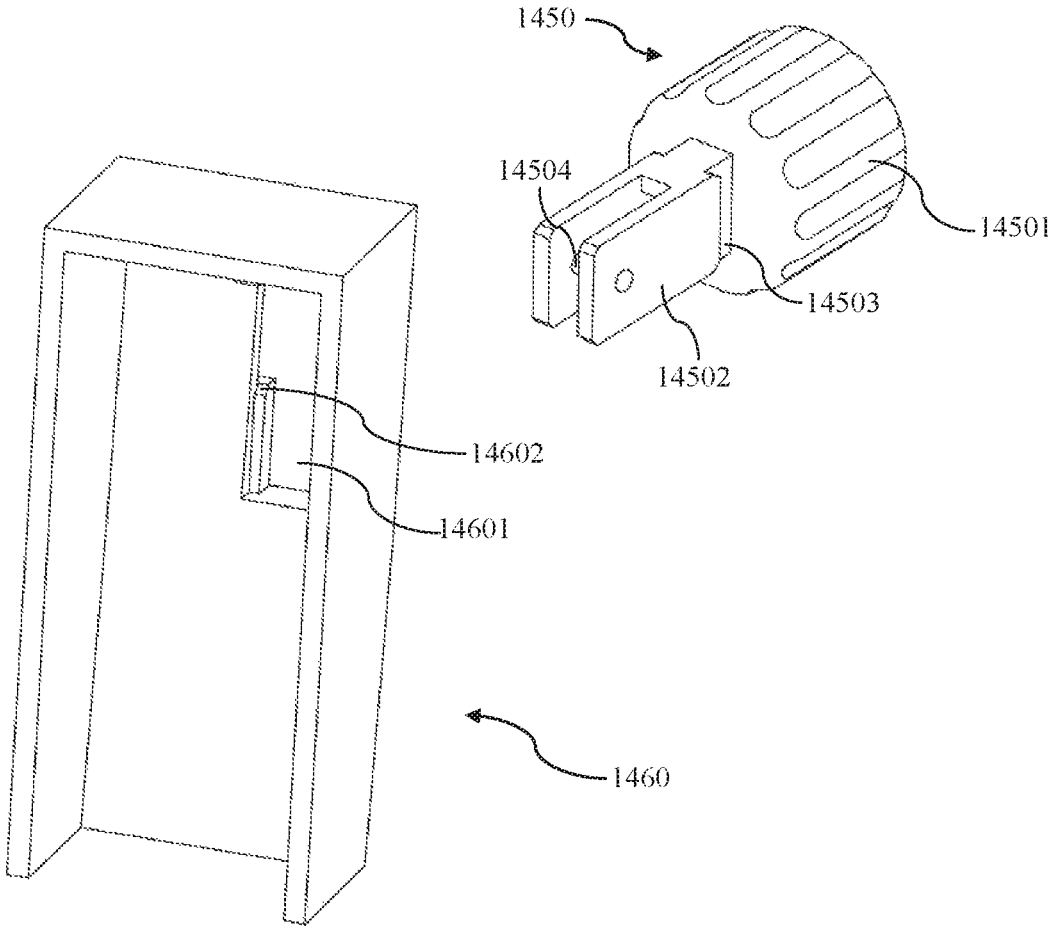
FIG. 18 is a partial exploded view of the swimming machine as shown in FIG. 17A showing a lifting handle and a supporting part for lifting handle.
Figure 19B:
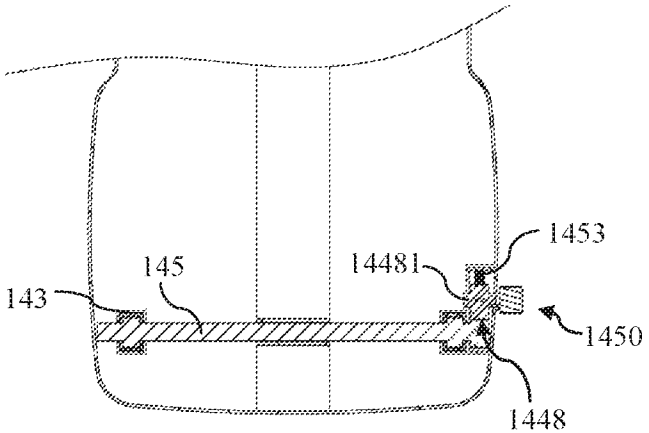
FIG. 19B is a cross-sectional view of the swimming machine as shown in FIG. 17A, showing engagement of the location part and the second ratchet.
Figure 19D:
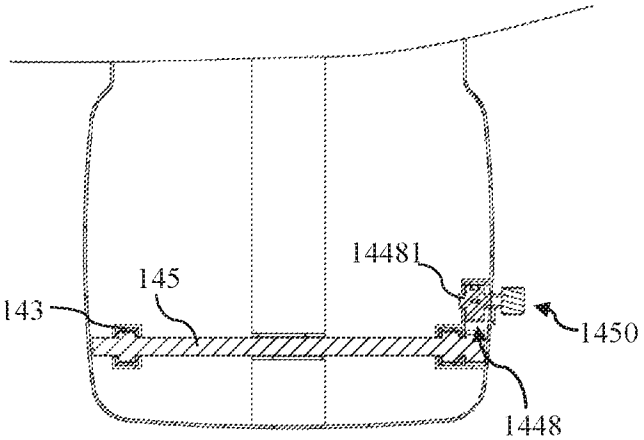
FIG. 19D is a partial cross-sectional view of the swimming machine as shown in FIG. 17A, showing separation of the location part from the second ratchet.
Figure 19A:
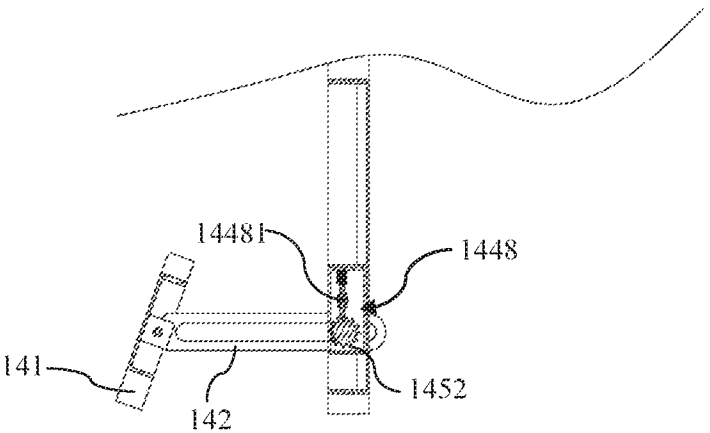
FIG. 19A is a partial front view of the swimming machine as shown in FIG. 17A, showing engagement of a location part and a second ratchet.
Figure 19C:
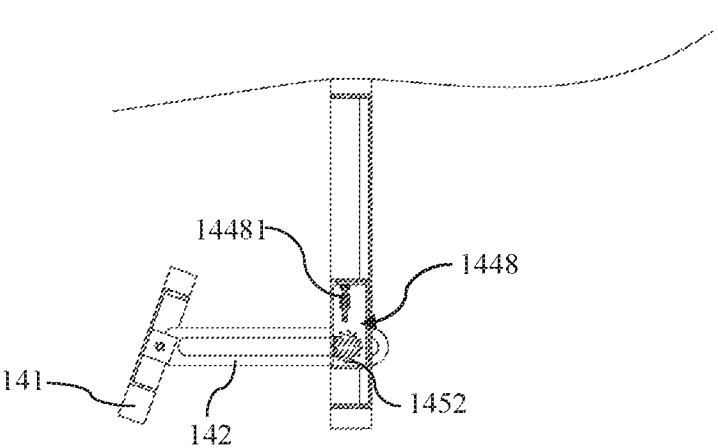
FIG. 19C is a partial front view of the swimming machine as shown in FIG. 17A, showing separation of the location part from the second ratchet.

As shown in FIGS. 17A and 18, the second fixing member 144 further comprises a lifting handle 1450 and a supporting part 1460 for the lifting handle which are adapted for controlling engagement or separation of location part 1448 and the second ratchet 1452, thereby stopping or allowing movement of the sliding member 142. In particular, the lifting handle 1450 comprises a holding part 14501 (or handle holding part 14501), a location engaging part 14502, and a lifting handle groove 14503 located between the location engaging part 14502 and the holding part 14501. The location engaging part 14502 is configured to engage with the location part 1448 through a connection part 14504. The supporting part 1460 for the lifting handle is mounted at the back of the housing 111 and comprises a second supporting opening 14601 disposed opposite to the first supporting opening 14491 and a groove engaging part 14602 disposed in the second supporting opening 14601. The second fixing member 144 further comprises a fourth spring 1453 (or lifting handle spring) disposed between the location part 1448 and the supporting part 1460 for the lifting handle. When the location part 1448 is engaged with the second ratchet 1452 (as shown in FIGS. 19A and 19B), the first supporting opening 14491 allows the first horizontal protrusion 14481 to insert therein and support the first horizontal protrusion 14481. The second supporting opening 14601 allows the location engaging part 14502 to insert therein. The groove engaging part 14602 is engaged with and supports the lifting handle groove 14503. The location engaging part 14502 can be moved upwardly to separate the location part 1448 from the second ratchet 1452 and separate the groove engaging part 14602 from the lifting handle groove 14503. The location engaging part 14502 can be supported on the top of the groove engaging part 14602, thereby allowing the sliding member 142 to slide forward or backward along the guiding part 143 for the sliding member.

In an alternative embodiment, the lifting handle and the supporting part for the lifting handle are omitted and replaced with any other suitable parts can be used to control engagement or separation of the location part with/from the second ratchet. In addition to the combinations that include the first embodiment of the adjusting assembly and the first embodiment of the supporting assembly (shown in FIG. 1) and that include of the third embodiment of the adjusting assembly and the second embodiment of supporting assembly (shown in FIG. 7), any embodiment of the adjusting assemblies set forth herein can be combined with any embodiment of the supporting assemblies set forth herein. No limitation is made in the present disclosure.

During operation of the swimming machine as described herein, the adjusting assembly is independent of the supporting assembly, such that the structure of the swimming machine is simplified, the cost is reduced, and the directed water flow can include a larger range of angles. Any members or elements as described above can be made from flexible thermoplastic materials or hard materials. Further, these elements or members can be coupled to each other by at least one of high frequency welding, adhesive, and other mechanical connection means known by one of ordinary skill in the art. In addition, it can be understood that all elements and features described herein can be made from various materials, including but not limited to, polymers, rubbers, foams, metals and other suitable materials known by one of ordinary skill in the art. In particular, any parts or elements in the swimming machine can be made from polyvinyl chloride (PVC) with hardness of 20±5 PHR. The hardness in unit of PHR refers to sum of the results obtained from dividing the added parts of the plasticizer per 100 parts of PVC by respective plasticization efficiency. For example, 30 parts of plasticizer A, 20 parts of plasticizer B, and 10 parts of plasticizer C are added into 100 parts of PVC, and the plasticization efficiency for plasticizer A is 2, the plasticization efficiency for plasticizer B is 2, the plasticization efficiency for plasticizer C is 1, the hardness can be calculated as 30/2+20/2+10/1=35. As such, the hardness per unit of PHR is 35.

While not limited thereto, the above elements can be made from the materials such as plastic, vinyl resin, coating fabric and/or another suitable materials or combination thereof and may also include processed aluminium or other metal alloys. Without departing from the spirit and scope of the present disclosure, one of ordinary skill in the art could make various modifications and changes to the present disclosure.

The detailed embodiments, as described herein, are merely intended to illustrate various aspects of the present invention. It will be apparent to those of ordinary skill in the art that various modifications may be made to the present invention and various equivalents thereof are within the scope of the invention, as claimed. Therefore, the specific embodiments, as set forth herein are merely intend for illustration. Various substitutions, combinations or modifications and all changes to the illustrative embodiments as mentioned above come within the scope of the present invention. In absence of any elements which are not disclosed in detail or optional elements as disclosed herein, the illustrative swimming machine can be suitably implemented. All values and ranges as mentioned above can be changed to some extent. When disclosing the value range with upper and lower limits, any values or subranges coming within the said value range can be considered as being disclosed in detail. In particular, it should be understood that any numerical range as disclosed herein can be considered as setting forth any value and range coming within the broad numerical range. In addition, the number of the elements in claims comprises one or at least one, unless otherwise indicated. If the terms or phrases used in the present disclosure have meanings inconsistent with those in other literatures, the terms or phrases used in the present disclosure have the meanings as defined herein.

What is claimed is:

1. A swimming machine for generating a directed water flow in a swimming pool, comprising:

a housing;

a water driver at least partially enclosed within the housing, the water driver adapted for generating the directed water flow;

an adjusting assembly located above and coupled to the housing, the adjusting assembly being adapted to hang on an upper edge of the pool and comprising an adjusting body;

an adjustable connector that couples the adjusting assembly to the housing and that is adjustable to permit moving the housing to any one of a plurality of different depths, the adjustable connector comprising:

a first connector fixedly coupled to the adjusting body and comprising multiple pairs of grooves between a top of the first connector and a bottom of the first connector, and a second connector coupled to the housing and comprising a supporting part, paired sliding blocks disposed on the supporting part, and a first spring disposed between the paired sliding blocks biasing the paired sliding blocks outwards toward the multiple pairs of grooves, the paired sliding blocks being configured to be separated from any pair of the multiple pairs of grooves by compressing the first spring and to be engaged with any pair of the multiple pairs of grooves by releasing the first spring, such that the second connector is detachably coupled to multiple locations along a vertical length of the first connector, and configured to move upward and downward relative to the first connector; and a supporting assembly coupled to and movable with the housing to provide a surface for contacting an inner wall of the pool to support the housing.

2. The swimming machine according to claim 1 including a guiding part extending vertically from the support part and that is adapted for receiving the paired sliding blocks and the first spring and for guiding the paired sliding blocks to press or release the first spring along a direction of the guiding part.

3. The swimming machine according to claim 2, wherein the second connector further comprises a driving part for compressing the first spring, a top part of the driving part including a pair of protrusions that defines a recess therebetween with at least one of the protrusions having an angled cam surface;

wherein at least one of the paired sliding blocks comprises a sliding block hollow part;

wherein the supporting part comprises a supporting hollow part that extends to the guiding part and the driving part is configured to pass through the supporting hollow part from a bottom of the supporting part to allow the protrusions to protrude through the sliding block hollow part and the guiding part; and a controlling part operably connected the protrusions to move them vertically with respect to the paired sliding blocks such that the angled cam surface compresses the first spring by pressing at least one of the paired sliding blocks inwardly.

4. The swimming machine according to claim 3, wherein the recess includes a narrow top and a wide bottom defined between the protrusions and a second spring is disposed between the controlling part and the housing; and the controlling part is configured to press the second spring to control the protrusions to move downward so that the angled cam surface drives the sliding blocks to compress the first spring.

5. The swimming machine according to claim 4, wherein the controlling part is further configured to release the second spring to allow the protrusions to release the sliding blocks such that the first spring is released by the paired sliding blocks.

6. The swimming machine according to claim 4, wherein the second connector further comprises a holding part located between the housing and the controlling part, the holding part including a holding groove for activating the controlling part by a user's hand, and wherein the second spring is disposed between the holding part and the controlling part.

7. The swimming machine according to claim 3, wherein the recess includes a wide top and a narrow bottom defined between the protrusions and the controlling part is configured to control the protrusions to move upward so that the angled cam surface drives the paired sliding blocks to compress the first spring.

8. The swimming machine according to claim 3, wherein the second connector further comprises an external cover fixed to the top of the supporting part and includes a cover groove sized to receive and retain the protrusions, the paired sliding blocks, the guiding part and the first spring.

9. The swimming machine according to claim 1, wherein the adjusting assembly further comprises a limiting member adjacent to the second connector and having a limiting protrusion disposed on the top thereof;

the adjusting body further comprising a receiving part having an engaging part for the limiting protrusion and allowing the limiting member to insert therein and move upward and downward; and the engaging part for the limiting protrusion is configured to engage with the limiting protrusion when the limiting member is set at a predetermined height, so as to prevent the limiting member from moving beyond a predetermined distance and to limit radial movement between the housing and the adjusting body.

10. The swimming machine according to claim 1, wherein the supporting assembly comprises a supporting member and a sliding member coupled to the supporting member at a back thereof;

a guiding part for the sliding member is disposed on the housing, and a front of the sliding member moves forward and backward along the guiding part for the sliding member; and the supporting assembly further comprises a slide fixing member for fixing the sliding member to a desired position along the guiding part for allowing the supporting member to be contacted against the inner wall of the pool at various angles.

11. The swimming machine according to claim 10, wherein the slide fixing member is disposed at a front of the sliding member and a side opening is disposed at the side of the housing and arranged parallel to the guiding part for receiving the sliding member, and the slide fixing member is configured to fix the sliding member at a predetermined position.

12. The swimming machine according to claim 11, wherein the slide fixing member includes an elastic stopping part and a pressing part that protrudes from the side opening and is operably connected to the elastic stopping part for pressing on the elastic stopping part and producing deformation;

the side opening having a stopping engaging part located for engagement with the elastic stopping part to prevent sliding of the sliding member, and the elastic stopping part being configured to be separated from the stopping engaging part under pressure of the pressing part to allow the sliding member to slide.

13. The swimming machine according to claim 12, wherein the slide fixing member further comprises a pressing support part protruding from the side opening and moving with the sliding member to support the pressing part and provide a handle to a user when the pressing part is used.

14. The swimming machine according to claim 11, wherein the slide fixing member comprises a rotation part, a rotation limiting part, a rotation rod protruded from the rotation part, and a third spring located on the rotation rod and disposed between the rotating part and the rotation limiting part; and a rotation engaging part located at the front of the sliding member such that when the rotating part is rotated to the rotation limiting part, the rotation rod is engaged with the rotation engaging part to prevent movement of the sliding member.

15. The swimming machine according to claim 14, wherein the rotation rod is in threaded connection with the engaging part.

16. The swimming machine according to claim 10, wherein the supporting assembly further comprises a supporting rod mounted at a back of the housing and having a first ratchet and a second ratchet adjacent to each other;

the sliding member having a hollow part with a third ratchet adapted for engaging with the first ratchet, the second ratchet being disposed outside of the hollow part; and the slide fixing member includes a location part adapted for engaging with the second ratchet to stop sliding of the sliding member and a location supporting part mounted at the back of the housing to support the location part.

17. The swimming machine according to claim 16, wherein the location part has a first horizontal protrusion, and the location supporting part has a first supporting opening for allowing the first horizontal protrusion to be located therein.

18. The swimming machine according to claim 17 including a lifting handle for raising and lowering the location part between a raised position that permits movement of the sliding member and a lower position that prevents movement of the sliding member via engagement of the location part and the second ratchet;

the lifting handle comprising a location engaging part operably connected to the location part between a connection part and a handle holding part;

a supporting part for the lifting handle is mounted at the back of the housing and includes a second supporting opening opposite to the first supporting opening and an engaging part for keeping the lifting handle in a raised position until manually moved; and a lifting handle spring disposed between the location part and the supporting part for biasing the lifting handle towards the lower position.

19. A swimming machine for generating a directed water flow in a swimming pool, comprising:

a housing;

a water driver at least partially enclosed within the housing, the water driver adapted for generating the directed water flow;

an adjusting assembly comprising a control interface for changing at least one setting of the water driver and an adjusting body, the adjusting assembly being located above and coupled to the housing and adapted to hang on an upper edge of the pool; and an adjustable connector that couples the adjusting assembly to the housing and is adjustable to permit moving the housing to any one of a plurality of different depths, the adjustable connector comprising:

a first connector fixedly coupled to the adjusting body and comprising multiple pairs of grooves between a top of the first connector and a bottom of the first connector; and a second connector coupled to the housing and comprising a supporting part, pairs sliding blocks disposed on the supporting part, and a first sprig disposed between the paired sliding blocks biasing the paired sliding blocks outwards toward the multiple pairs of grooves, the paired sliding blocks being configured to be separated from any pair of the multiple pairs of grooves by compressing the first spring and to be engaged with any pair of the multiple pairs of grooves by releasing the first spring, such that the second connector is detachably coupled to multiple locations along a vertical length of the first connector, and configured to move upward and downward relative to the first connector.

20. The swimming machine according to claim 19, further including a buffering member located between the housing and the adjusting assembly and at least partially enclosing the adjustable connector.

* * * * *